United States Patent [19]

Kasai

[11] Patent Number: 4,672,725

[45] Date of Patent: Jun. 16, 1987

[54] SNAP BUCKLE

[75] Inventor: Kazumi Kasai, Namerikawa, Japan

[73] Assignee: Yoshida Kogyo K. K., Tokyo, Japan

[21] Appl. No.: 871,247

[22] Filed: Jun. 6, 1986

[30] Foreign Application Priority Data

Jun. 6, 1985 [JP] Japan ..... 60-85659[U]
Dec. 28, 1985 [JP] Japan ..... 60-204494[U]

[51] Int. Cl.[4] ..... A44B 11/25
[52] U.S. Cl. ..... 24/625; 24/664
[58] Field of Search ..... 24/625, 604, 618, 614, 24/194, 171, 633, 664, 665

[56] References Cited

U.S. PATENT DOCUMENTS

| | | | |
|---|---|---|---|
| 1,737,246 | 11/1929 | Jones | 24/625 |
| 3,430,306 | 3/1969 | Tareau | 24/625 |
| 4,110,873 | 9/1978 | Verchere | 24/618 |
| 4,425,689 | 1/1984 | Fildan | 24/664 |
| 4,577,377 | 3/1986 | Kasai | 24/625 |

FOREIGN PATENT DOCUMENTS 59-31908 2/1984 Japan .

*Primary Examiner*—Victor N. Sakran
*Attorney, Agent, or Firm*—Hill, Van Santen, Steadman & Simpson

[57] ABSTRACT

A buckle comprises a male member having a pair of resilient legs releasably engageable with a socket portion of a female member to couple the male and female members, the female member having a pair of cantilevered resilient arms resiliently flexible toward each other to urge the legs out of interlocking engagement with the socket portion. The arms are disposed between a pair of opposed plates of the socket member and have stop fingers loosely received in apertures in one of the plates. With this construction, the resilient arms are protected against damage or breakage when subjected to forces tending to flex the arms in a direction either parallel to or perpendicular to the general plane of the socket portion. The male member includes a generally U-shaped reinforcing rib disposed between and connected with the legs with a U-shaped slit defined therebetween so as to increase the resiliency of the legs.

11 Claims, 16 Drawing Figures

SNAP BUCKLE

BACKGROUND OF THE INVENTION

1. Field of the Invention

The present invention relates to a buckle for releasably connecting loose ends of an article such as a belt or strap applied to garments.

2. Prior Art

Japanese Utility Model Laid-open Publication No. 59-31908 discloses, as reillustrated here in FIGS. 15 and 16, a buckle including a male member A and a female member B releasably couplable together through an inter-locking engagement between a pair of resilient legs C of the male member A and a socket portion of the female member B. The female member B includes a pair of resilient arms D, D disposed on opposite sides of the socket portion and resiliently flexible toward each other to urge the legs C, C out of interlocking engagement with the socket portion for uncoupling the male and female members A, B. The female member further includes a pair of stopper lugs E, E disposed outwardly of the distal ends of the respective arms. The stopper lugs E, E are engageable with the arm's distal ends to limit the lateral movement of the arms D, D, thereby preventing the arms D, D from being broken when they are spread away from one another. The female member B has no means for preventing the arm D, D from moving in a direction perpendicular to the general plane of the female member B with the result that the arms D, D are likely be broken when subjected to forces applied thereto in said direction. Another drawback associated with the prior buckle is in that the legs C, C have a varying width progressively reducing from the distal ends toward the proximal ends thereof for increasing the resiliency of the legs C, C. Due to such varying width, the legs are likely to be broken at the proximal ends during frequent coupling and uncoupling operations of the buckle.

SUMMARY OF THE INVENTION

It is accordingly an object of the present invention to provide a buckle in which resilient arms of a female member are protected from damage or breakage when subjected to lateral pulling forces tending to spread the arms as well as to forces applied to the arms in a direction perpendicular to the general plane of the female member.

According to the present invention, a buckle comprises a male member including a pair of resiliently flexible legs, and a female member having a socket portion releasably couplable with the legs, the socket portion having a pair of opposed plates between which there are defined a central slot for receiving therein the legs, and a pair of lateral grooves disposed on opposite sides of the slot. The female member further includes a pair of cantilevered resilient arms respectively disposed in the lateral grooves in the socket portion, the arms being engageable with the plates when subjected to forces applied thereto in a direction perpendicular to the general plane of the female member. The arms have a pair of stop fingers respectively disposed on the distal ends thereof and received in a pair of recessed portions defined in one of the plates and facing the respective lateral grooves. The stop fingers are engageable with the recessed portions to thereby limit movement of the arm in a direction away from one another. The male member further includes a generally U-shaped reinforcing rib disposed between the legs and connected at its opposite ends with the distal ends of the legs so as to increase the resiliency of the legs.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 9:
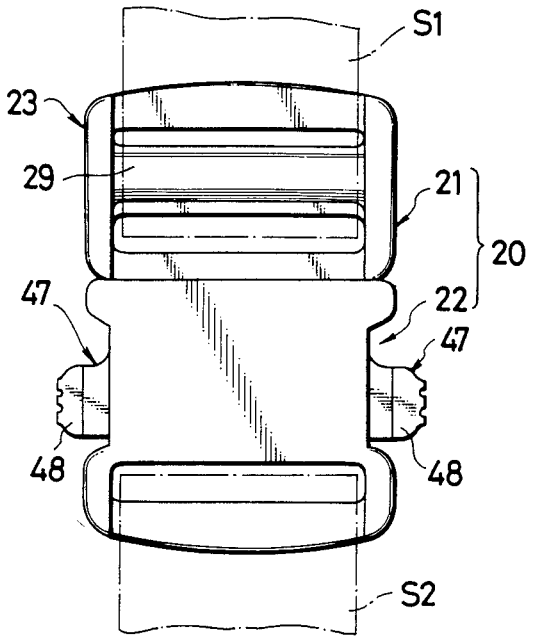
FIG. 9 is a plan view of the male and female members of the buckle shown engaged or connected.

The principles of the present invention are particularly useful when embodied in a buckle as shown in FIG. 9, generally indicated by the numeral 20. The buckle 20 comprises a male or plug member 21 and a female or socket member 22 releasably coupled with the male member 21.

Figure 1:
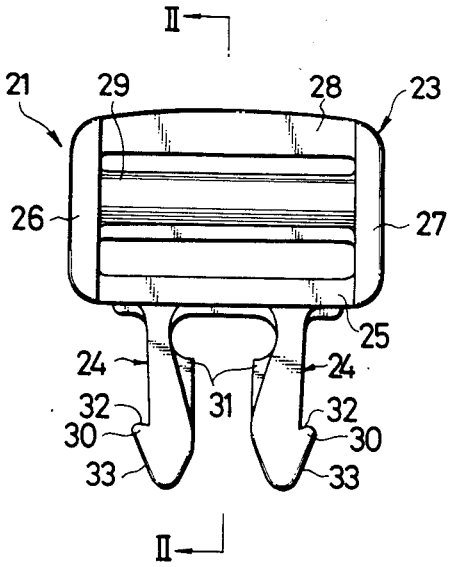
FIG. 1 is a plan view of a male or plug member which constitutes one part of a buckle embodying the present invention.
Figure 2:
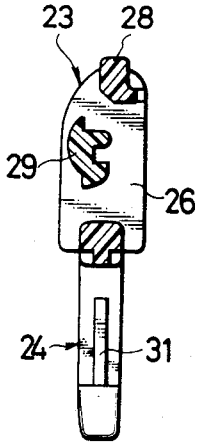
FIG. 2 is a cross-sectional view taken along line II—II of FIG. 1.
Figure 3:
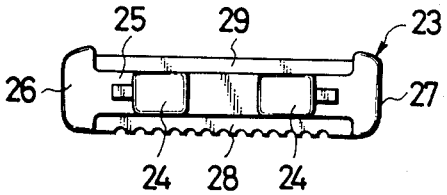
FIG. 3 is an end elevational view of FIG. 1.
Figure 4:
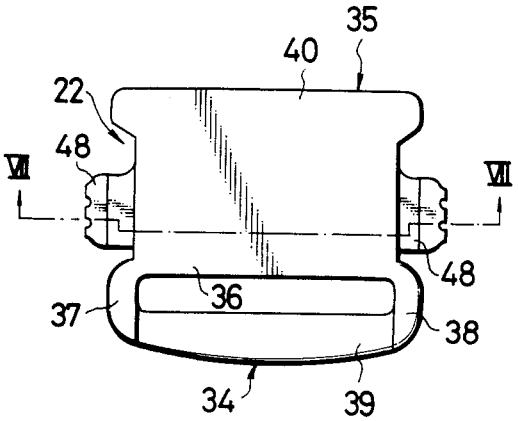
FIG. 4 is a plan view of a female or socket member which constitutes the other part of the buckle.
Figure 5:
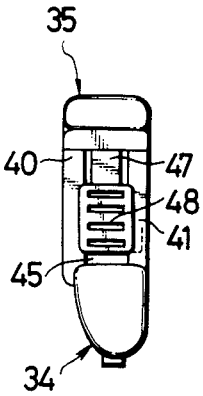
FIG. 5 is a side elevational view of FIG. 4.

As better shown in FIG. 1, the male member 21 includes a hollow connector frame 23 of a rectangular shape, and a pair of resiliently flexible legs 24, 24 integrally formed with the hollow connector frame 23. The connector frame 23 and the legs 24, 24 are integrally molded of synthetic resin, such as polyacetal, nylon or polypropylene.

The hollow connector frame 23 comprises a base 25, a pair of spaced parallel stems 26, 27 extending transversely from opposite ends of the base 25, a connecting bar 28 transversely joining the stems 26, 27 at distal ends thereof remote from the base 25, and a crossbar 29 extending between the stems 26, 27 parallel to the base 25 for retaining thereon a loop of one strap end portion S1 (FIG. 9).

The legs 24, 24 extend from the base 25 away from the connecting bar 28 and have a pair of locking projections 30, 30 projecting from the distal ends thereof laterally away from one another. Each of the legs 24, 24 has a longitudinal reinforcing fin 31 projecting from an inner sidewall thereof away from the locking projection 30. The locking projections have a pair of abutment surfaces 32, 32, respectively, facing toward the base 25, and a pair of sliding surfaces 33, 33 extending respectively from the abutment surfaces 32, 32 convergently toward the distal ends of the respective legs 24, 24.

The female member 22, as shown in FIGS. 4 to 8, includes a hollow connector frame 34 of a rectangular shape, and a socket portion 35 integrally formed with the hollow connector frame 34 for receiving therein the legs 24 of the male member 21 (FIG. 1). The connector frame 34 and the socket portion 35 are molded of synthetic resin, such as polyacetal, nylon or polypropylene.

The hollow connector frame 34 comprises a base 36, a pair of spaced parallel stems 37, 38 extending from opposite ends of the base 36, and a connecting bar 39 joining the ends of the stems 37, 38 which are remote from the base 36. Another strap end portion S2 (FIG. 9) is attached to the connector frame 34 with a loop extending around the connecting bar 39. The connector frame 34 may have the same structure as the connector frame 23 of the male member 21.

Figure 6:
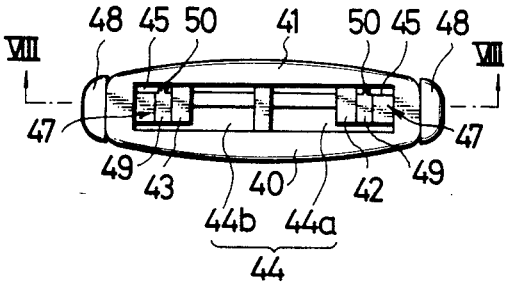
FIG. 6 is an end elevational view of FIG. 4.

The socket portion 35 includes a pair of opposed top and bottom plates 40, 41 of a rectangular shape extending from the base 36 away from the connecting bar 39, and a pair of spaced guide walls 42, 43 projecting from an inner surface of the bottom plate 41 and extending longitudinally of the top and bottom plates 40, 41 so as to define therebetween a central slot 44 and a pair of lateral grooves 45, 45 disposed one on each side of the slot 44 (FIG. 6). The socket portion 35 further includes a central partition wall 46 interconnecting the top and bottom walls 40, 41 and separating the central slot 44 into two slot portions **44*a*, 44*b* (FIGS. 6–8) for receiving respectively therein the legs 24 of the male member 21. The partition wall 46 is joined at one end thereof with the base 36 of the connector frame 34. As shown in FIG. 8, the guide walls 42, 43 are spaced equidistantly therefrom and have a pair of opposed inner guide surfaces 42*a*, 43*a* extending substantially parallel to the partition wall 46, and a pair of retaining surfaces 42*b*, 43*b* blending into the respective inner guide surfaces 42*a*, 43*a* and facing toward the base 36**.

Figure 7:
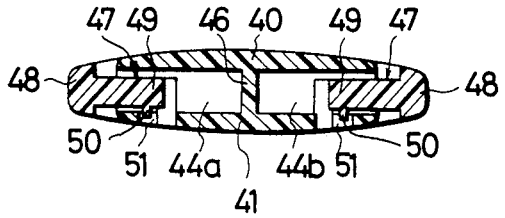
FIG. 7 is a cross-sectional view taken along line VII—VII of FIG. 4.
Figure 8:
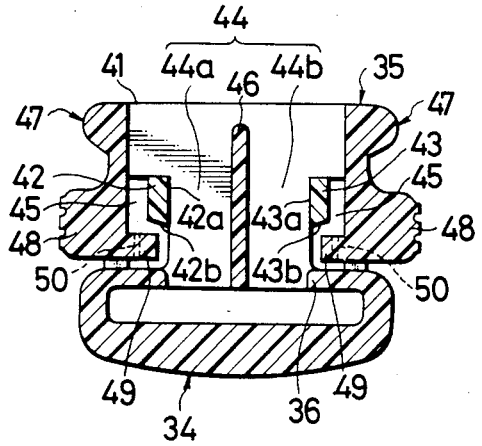
FIG. 8 is a cross-sectional view taken along line VIII—VIII of FIG. 6.

The socket portion 35 also includes a pair of cantilevered resilient arms 47, 47 disposed respectively in the lateral grooves 45, 45 (FIGS. 6 and 7). The arms 47, 47 have respective proximal ends connected with the top and bottom plates 40, 41 at one end of the latter which is remote from the base 36. The arms 47, 47 extend toward the base 36 along opposite longitudinal edges of each plate 40, 41 and terminate short of the base 36. The arms 47, 47 have respective distal ends disposed adjacent to the retaining surfaces **42*b*, 43*b* of the guide walls 42, 43**.

Each of the resilient arms 47, 47 has an integral enlarged finger grip 48 disposed on the distal end thereof and projecting transversely outwardly from the lateral groove 45. The arm 47 further has an actuating lug 49 disposed on the distal end thereof and projecting therefrom toward the central partition wall 46, the actuating lug 49 terminating short of the central slot 44, as shown in FIG. 8. The actuating lug 49 includes an integral stop finger 50 projecting perpendicular to the general plane of the socket portion 35 and loosely received in a recessed portion 51 of the bottom plate 41, as shown in FIG. 7. The recessed portion 51 comprises an aperture communicating with both the slot 44 and the lateral groove 45 for allowing only a limited lateral movement of the stop finger 50. The aperture 51 may be provided in the top plate 40 which constitutes an obverse side of the buckle 20, but it is not preferable to do so because the aperture 51 is visible from the outside and hence makes the buckle 20 unsightly in appearance.

Figure 10:
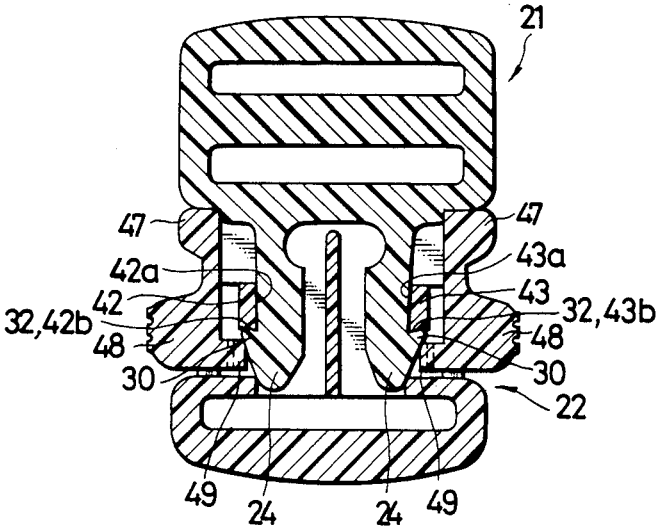
FIG. 10 is a horizontal cross-sectional view of FIG. 9.

To couple the male and female members 21, 22 of the buckle 20 as shown in FIGS. 9 and 10, the resilient legs 24, 24 of the male member 21 are inserted into the socket portion 35 of the female member 22. In this instance, the inner guide surfaces **42*a*, 43*a* of the guide walls 42, 43 are brought into frictional engagement with the locking projections 30, whereupon the legs 24 are urged to flex resiliently toward each other. Further advancing of the legs 24 causes the locking projections 40 to move past the respective inner guide surfaces 42*a*, 43*a*, thus enabling the legs 24 to expand to their original position. In this position, the abutment surfaces 32 of the locking projections 30 are brought into engagement with the retaining surfaces 42*b*, 43*b* of the guide walls 42, 43, thereby locking the male and female members 21, 22 in coupled condition. The actuating lugs 49 are held in touch with the locking projections 30 so that they do not apply to the legs 24 any forces tending to cause disengagement of the projections 30 and the guide walls 32, 33. When the surfaces 32, 42*b*, 43*b* abut together, they generate a pleasant sound of engagement, thus enabling a user to cease further advancing of the legs 24 in the socket portion 35**.

To disengage the male and female members 21, 22, the finger grips 48 are pressed by a user's fingers to resiliently flex the arms 47 toward each other, whereupon the actuating lugs 49 urge the projections 30 toward each other against the resiliency of the legs 24. Further pressing on the finger grips 48 causes the abutment surfaces 32 to disengage from the retaining surfaces **42*b*, 43*b*, thus allowing the male member 21 to be detached from the female member 22. In this instance, the legs 24 are thrusted out from the socket portion 35** by the resilient forces stored therein.

The buckle 20 thus constructed has many advantages: With the resilient arms 47 being disposed in the lateral grooves 45 defined between the top and bottom plates 40, 41, when the arms 47 are subjected to forces tending to flex the arms 47 in a direction perpendicular to the general plane of the socket portion 35, movement of the arms 47 in said direction is limited by the top and bottom plates 40, 41. Movement of the arms 47 away from one another in the general plane of the socket portion 35 is limited by the stop fingers 50 received in the apertures 51 in the bottom plate 41. Furthermore, movement of the arms 47 toward each other is also limited by the guide walls 42, 43 disposed inwardly of the arms 47.

Figure 11:
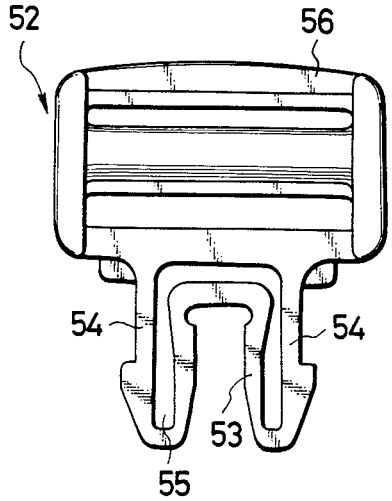
FIG. 11 is a plan view of a modified male member.
Figure 12:
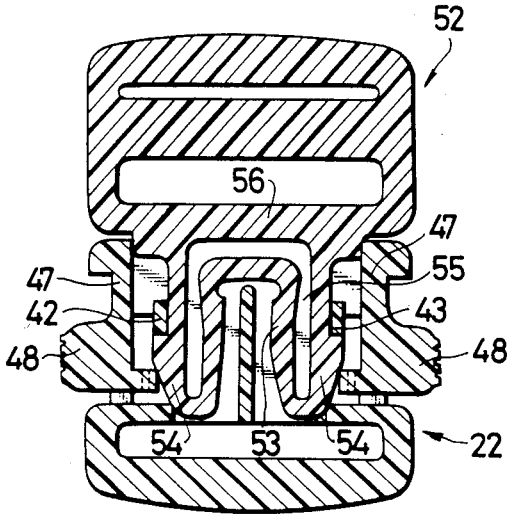
FIG. 12 is a horizontal cross-sectional view of a buckle having the male member shown in FIG. 11.

FIGS. 11 and 12 show a modified male member 52 which is substantially the same as the male member 21 shown in FIG. 1 with the exception that a generally U-shaped reinforcing rib 53 is disposed between a pair of resilient legs 54, 54 of the male member 52 with a U-shaped slit 55 extending along the legs 54 and a connector frame 56 of the male member 52. The U-shaped reinforcing rib 53 is connected at its opposite ends with respective distal ends of the legs 54, 54. The reinforcing rib 53 has the same thickness as the legs 54. With the reinforcing rib 53 thus provided, the legs 54 have an increased degree of resiliency which is large enough to withstand forces tending to flex the legs 54 toward and away from each other. The male member 52 thus constructed is coupled with the female member 22 as shown in FIG. 12.

Figure 13:
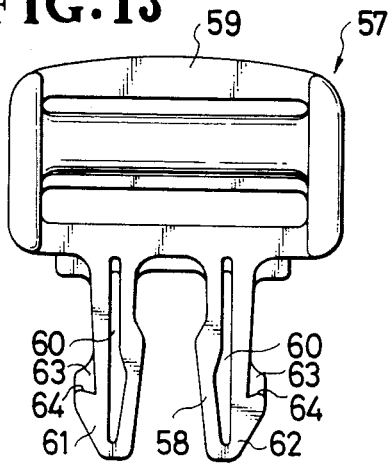
FIG. 13 is a plan view of another modified male member.
Figure 14:
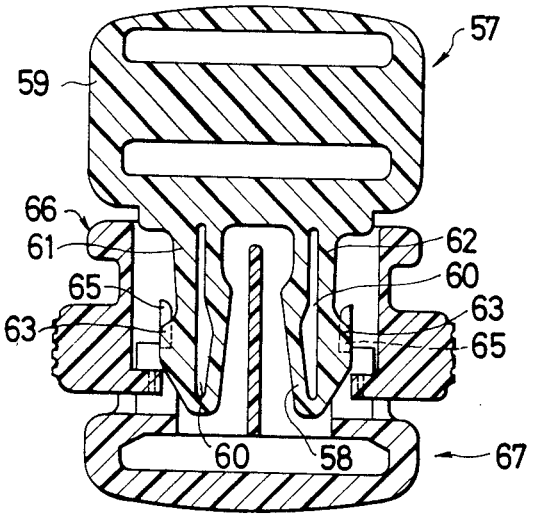
FIG. 14 is a horizontal cross-sectional view of a buckle having the male member shown in FIG. 13.
Figure 15:
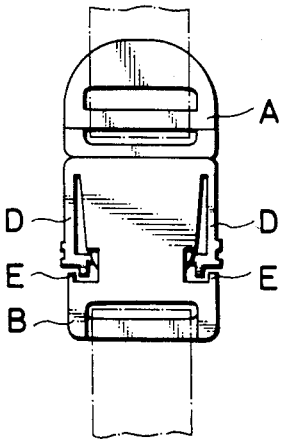
FIG. 15 (PRIOR ART)
FIG. 15 is a schematic plan view of a known buckle.
Figure 16:
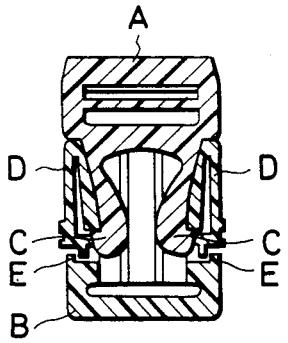
FIG. 16 (PRIOR ART)
FIG. 16 is a horizontal cross-sectional view of the known buckle shown in FIG. 15.

Another modified male member 57 shown in FIGS. 13 and 14 is similar to the male member shown in FIG. 11 but differs therefrom in that a generally U-shaped reinforcement rib 58 is integral with a connector frame 59 of the male member 57 so that a pair of slits 60 is defined respectively between the reinforcing rib 58 and one resilient leg 61 and between the reinforcing rib 58 and another resilient leg 62. The legs 61, 62 have a pair of guide fins 63, 63 respectively projecting from abutment surfaces 64, 64 of the legs 61 toward the connector frame 59, 62. The fins 63, 63 are guidedly receivable between opposed pairs of guide walls 65, 65 (only one pair being shown in FIG. 14) of the socket portion 66 of a female member 67 when the male and female members 57, 67 are coupled together. Other structural details of the female member 67 are the same as the female member 22 shown in FIG. 4 and description is not necessary.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A buckle for fastening two end portions of an article, comprising:

(a) a male member adapted to be connected to one of the end portions of the article and including a pair of resiliently flexible legs having a pair of abutment surfaces; and (b) a female member adapted to be connected to the other end portion of the article and including a socket portion couplable with said legs, said socket portion including (1) a pair of opposed plates and a pair of spaced guide walls projecting from an inner surface of one of said plates toward the other plate and extending longitudinally of said plates so as to define therebetween a central slot for receiving therein said legs, and a pair of lateral grooves disposed on opposite sides of said slot, one of said plates having a pair of recessed portions facing said lateral grooves, respectively, said guide walls having a pair of retaining surfaces respectively engageable with said abutment surfaces of said legs to interlock said male and female members, and (2) a pair of cantilevered resilient arms having at distal ends thereof a pair of actuating lugs extending toward each other and engageable with said legs to bring said abutment surfaces out of interlocking engagement with said retaining surfaces, said actuating lugs being disposed respectively in said lateral grooves and having a pair of stop fingers projecting therefrom into said recessed portions of said one plate.

2. A buckle according to claim 1, said male member further including a first connector frame adapted to be connected to the one end portion of the article, said legs extending from said first connector frame in a common direction, said abutment surfaces facing toward said first connector frame, said female member further including a second connector frame adapted to be connected to the other end portion of the article, said plates extending from said second connector frame, said retaining surfaces facing toward said second connector frame.

3. A buckle according to claim 1, said socket portion further including a pair of enlarged finger grips respectively disposed on said distal ends of said arms and projecting transversely outwardly from said lateral grooves.

4. A buckle according to claim 1, said arms being disposed in said lateral grooves and having proximal ends joined with said plates at one end of the latter, said arms extending along opposite longitudinal edges of each said plate.

5. A buckle according to claim 1, said socket portion further including a central partition wall disposed centrally in said slot and spaced equidistantly from said guide walls to separate said slot into two slot portions for receiving therein said legs, respectively.

6. A buckle according to claim 1, said legs including a pair of guide fins projecting respectively from said abutment surfaces toward proximal ends thereof, said socket portion including a further pair of guide walls disposed on the other plate in confronting relation to the first-mentioned guide walls, said guide fins being guidedly receivable between said first-mentioned guide walls and the last-mentioned guide walls.

7. A buckle according to claim 1, said recessed portions of said one plate comprising apertures communicating with said lateral grooves, respectively.

8. A buckle according to claim 1, said male member further including a generally U-shaped reinforcing rib disposed between and extending along said legs with a pair of slits defined therebetween, said U-shaped reinforcing rib having opposite ends connected to the distal ends of said legs.

9. A buckle according to claim 8, said male member further including a connector frame adapted to be connected to the one end portion of the article, said legs extending from said connector frame in a common direction, said U-shaped reinforcing rib being spaced from said first connector frame, said slits being contiguous to one another into a U-shape.

10. A buckle according to claim 8, said male member further including a connector frame adapted to be connected to the one end portion of the article, said legs extending from said connector frame in a common direction, said U-shaped reinforcing rib being joined with said first connector frame.

11. A buckle according to claim 8, said reinforcing rib having the same thickness as said legs.

* * * * *